US012305644B1

(12) United States Patent
Hou

(10) Patent No.: US 12,305,644 B1
(45) Date of Patent: May 20, 2025

(54) COOLING PUMP ASSEMBLY

(71) Applicant: Cheng-Jiang Hou, Kaohsiung (TW)

(72) Inventor: Cheng-Jiang Hou, Kaohsiung (TW)

( * ) Notice: Subject to any disclaimer, the term of this patent is extended or adjusted under 35 U.S.C. 154(b) by 0 days.

(21) Appl. No.: 18/619,147

(22) Filed: Mar. 27, 2024

(51) Int. Cl.

| | |
|---|---|
| ***F04C 2/10*** | (2006.01) |
| ***F04C 15/00*** | (2006.01) |
| ***F04C 18/10*** | (2006.01) |
| ***F04C 29/04*** | (2006.01) |

(52) U.S. Cl.
CPC ..... *F04C 2/101* (2013.01); *F04C 15/0061* (2013.01); *F04C 15/0096* (2013.01); *F04C 18/103* (2013.01); *F04C 29/042* (2013.01); *F04C 2240/30* (2013.01)

(58) Field of Classification Search
CPC .... F04C 2/101; F04C 18/103; F04C 15/0061; F04C 15/0096; F04C 29/0042; F04C 29/005; F04C 29/04; F04C 29/042; F04C 2240/30
See application file for complete search history.

(56) References Cited

U.S. PATENT DOCUMENTS 1,379,248 A * 5/1921 Carrey ..... F04C 2/101 418/170
3,597,129 A * 8/1971 Crowther ..... F04C 2/101 418/170
4,247,267 A * 1/1981 Lindtveit ..... F04C 14/04 418/32
6,149,415 A 11/2000 Thompson et al.
2004/0223864 A1 11/2004 Miller et al.
2010/0028172 A1* 2/2010 Heuver ..... F04C 2/101 418/170
2022/0166284 A1* 5/2022 Busquets ..... F04C 2/102

FOREIGN PATENT DOCUMENTS

NL 2028699 B1 * 1/2023 ..... B60G 17/04
WO 2022251157 A2 12/2022

* cited by examiner

*Primary Examiner* — Theresa Trieu
(74) *Attorney, Agent, or Firm* — Hershkovitz & Associates, PLLC; Abe Hershkovitz

(57) ABSTRACT

A cooling pump assembly has a cooling pump, a mount, a shaft, and a driving set. Wherein, a driving unit of the driving set is configured to connect a device to be cooled and has a central hole fluidly communicating with an interior of the cooling pump. The shaft is inserted in the cooling pump, the mount, and the driving unit. The shaft is connected to the driving unit and the cooling pump. The shaft has a channel fluidly communicating with the device to be cooled and fluidly communicating with the channel and the central hole via multiple guiding holes of the shaft. Therefore, the cooling pump assembly and the device to be cooled can be driven by a same motor.

15 Claims, 10 Drawing Sheets

COOLING PUMP ASSEMBLY

BACKGROUND OF THE INVENTION

1. Field of the Invention

The present invention relates to a cooling device, and more particularly to a cooling pump assembly that can save the energy of operating.

2. Description of Related Art

In the industrial field, components such as output spindles, generator spindles, etc., generate heat energy by operation. The components have to be cooled by liquid coolant transmitted by cooling pumps for continuously operating.

At present, conventional cooling pumps require additional motors to power the conventional cooling pumps to operate. The liquid coolant driven by the conventional cooling pumps drives the liquid coolant to cool down the components that generate heat energy. After the liquid coolant absorbs the heat energy, the liquid coolant needs to be transmitted in a heat exchanger for lowering the temperature of the liquid coolant. Consequently, the cooled-down liquid coolant can be repeatedly transmitted to the components generating heat energy for recycling.

However, additional motors for powering the conventional cooling pumps consume additional energy and increase the cost of purchasing the motors. The conventional cooling pumps have to be improved.

To overcome the shortcomings of the conventional cooling pumps, the present invention provides a cooling pump assembly to mitigate or obviate the aforementioned problems.

SUMMARY OF THE INVENTION

The main objective of the present invention is to provide a cooling pump assembly without needing to equip any additional motor for operating.

The cooling pump assembly has a cooling pump, a mount, a shaft, and a driving set. The cooling pump has a main casing, a supplementary casing, an inner gear, and an outer gear.

The main casing has a first end and a second end opposite to the first end of the main casing, a chamber disposed at the second end of the main casing, an axial hole extending from the first end of the main casing and fluidly communicating with the chamber, a crescent being curved, and a communicating hole fluidly communicating with the axial hole and the chamber. Wherein, the crescent is disposed inside the chamber and surrounds the axial hole.

The supplementary casing is connected to the main casing, closes the chamber, and has a first side and a second side opposite to the first side of the supplementary casing, a leading-in indent disposed at the first side of the supplementary casing, a leading-out indent disposed at the first side of the supplementary casing, at least one leading-in hole, and a leading-out hole. Each of the at least one leading-in hole extends from a bottom of the leading-in indent and extends through the second side of the supplementary casing. The leading-out hole extends from a bottom of the leading-out indent and extends through the second side of the supplementary casing.

The inner gear is rotatably disposed inside the chamber and is coaxial with the axial hole. The outer gear is rotatably disposed inside the chamber, encloses the inner gear and the crescent, and engages with the inner gear. Wherein, the outer gear and the inner gear are eccentric.

The mount has a first side and a second side opposite to the first side of the mount, a recess disposed at the first side of the mount, and a discharging hole extending from a bottom of the recess and fluidly communicating with an exterior of the mount. Wherein, the recess receives the supplementary casing and fluidly communicates with the at least one leading-in hole and the leading-out hole.

The shaft is rotatably mounted in the axial hole and engages with the inner gear. The shaft has an input end and an output end opposite to the input end of the shaft, a channel extending from the input end of the shaft toward the output end of the shaft, and multiple guiding holes radially extending from a circumference of the shaft and fluidly communicating with the channel.

The driving set has a driving unit. The driving unit is connected to the shaft, is inserted in the axial hole, and has a first end and a second end opposite to the first end of the driving unit and a central hole extending to the first end and the second end of the driving unit. The central hole fluidly communicates with the axial hole.

The driving unit is mounted on and around the shaft by the central hole, and the central hole fluidly communicates with the axial hole and fluidly communicates with the channel via the multiple guiding holes.

Other objects, advantages, and novel features of the invention will become more apparent from the following detailed description when taken in conjunction with the accompanying drawings.

DETAILED DESCRIPTION OF PREFERRED EMBODIMENTS

The present invention provides a cooling pump assembly 100 configured to connect a device to be cooled and a loading device. The device to be cooled may be a coupling, and the loading device may be an electrical generator. Wherein, the coupling increases its rotational inertia by flowing fluid.

Figure 1:
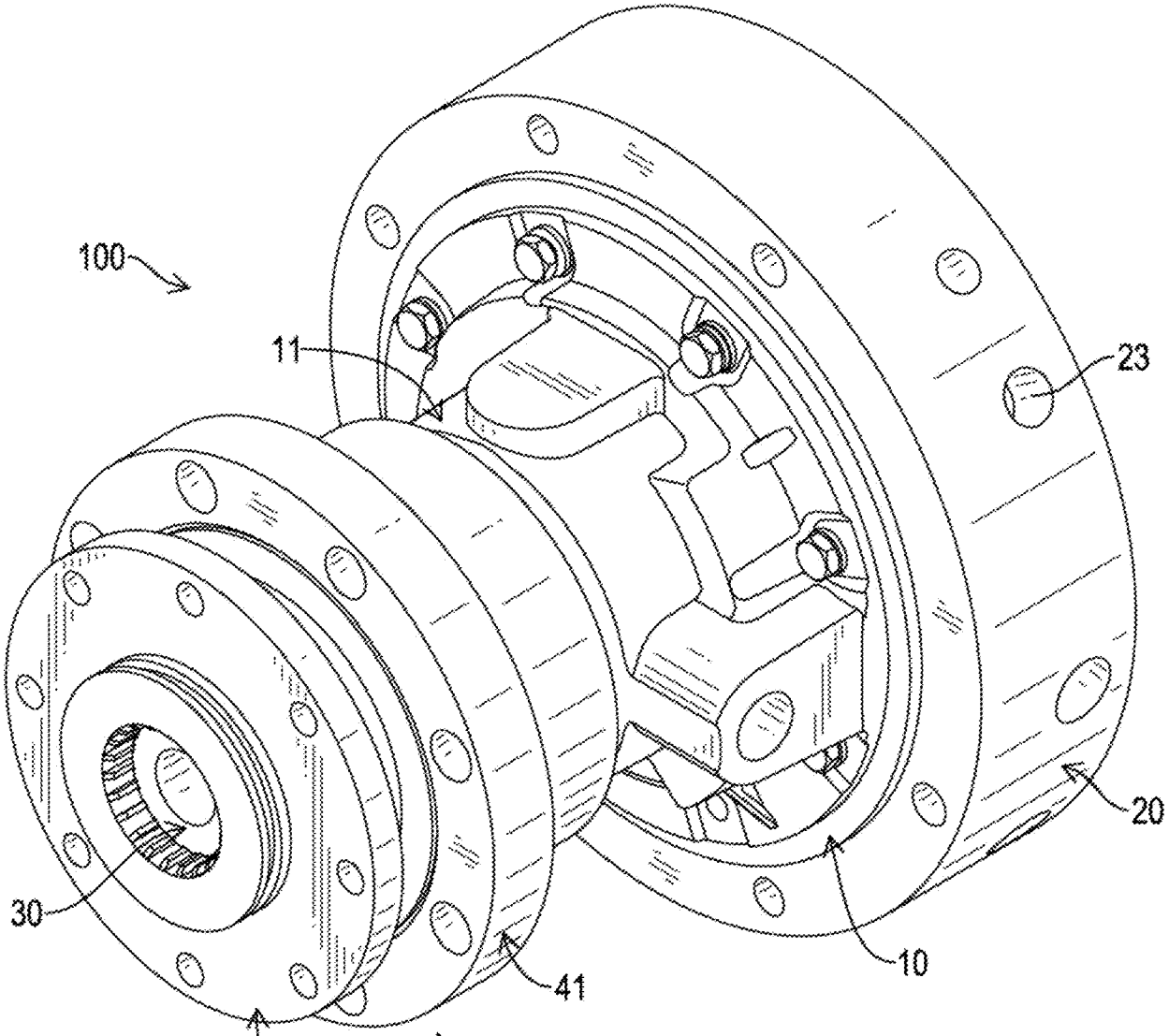
FIG. 1 is a perspective view of a cooling pump assembly in accordance with the present invention.
Figure 2:
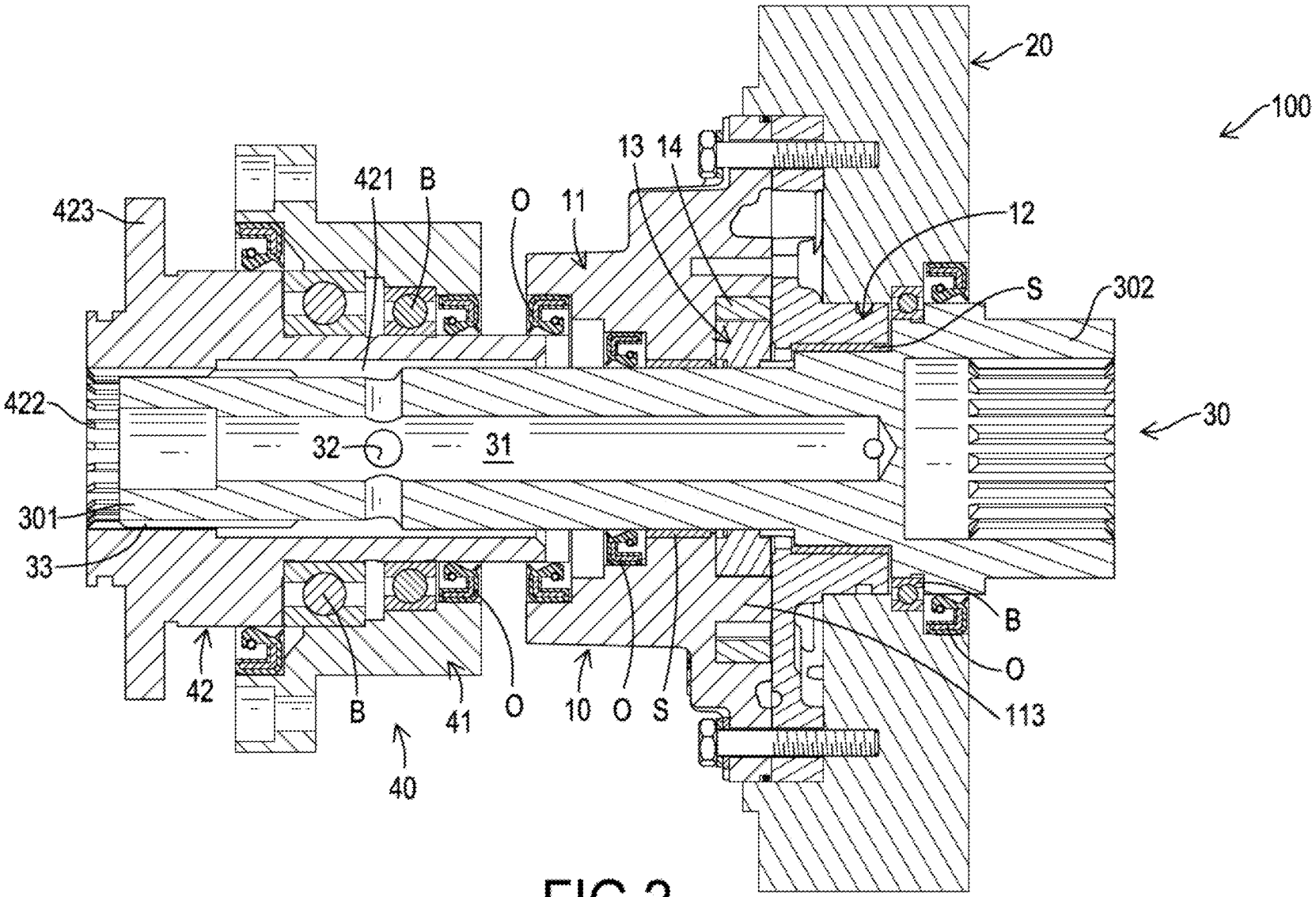
FIG. 2 is a perspective cross-sectional view of the cooling pump assembly in FIG. 1.
Figure 3:
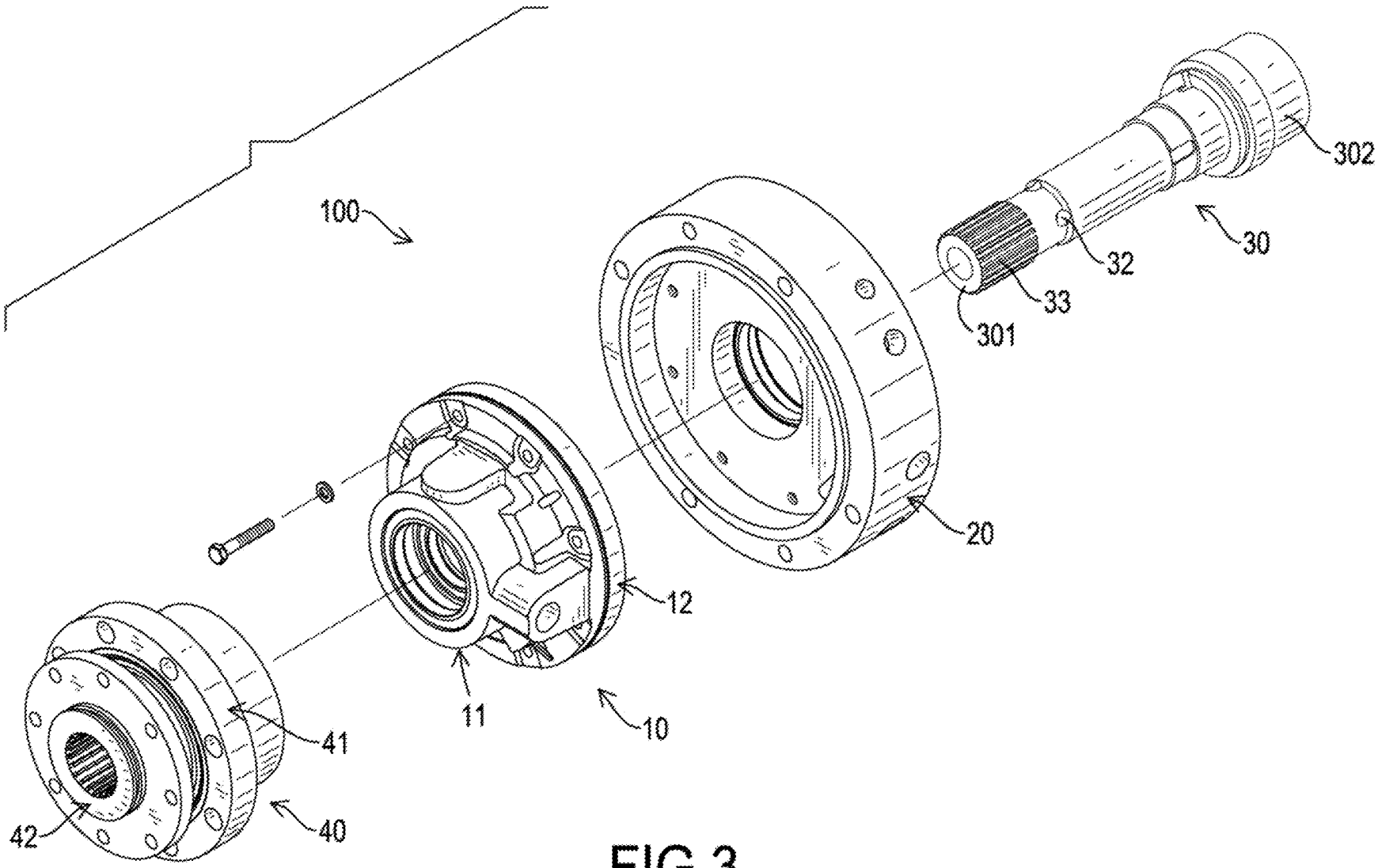
FIG. 3 is an exploded perspective view of the cooling pump assembly in FIG. 1.

With reference to FIGS. 1 to 3, the cooling pump assembly 100 has a cooling pump 10, a mount 20, a shaft 30, and a driving set 40.

With reference to FIGS. 1 to 4, the cooling pump 10 has a main casing 11, a supplementary casing 12, an inner gear 13, and an outer gear 14.

With reference to FIGS. 1 to 5, the main casing 11 has a first end and a second end opposite to the first end of the main casing 11. The main casing 11 further has a chamber 111, an axial hole 112, a crescent 113, and a communicating hole 114. Wherein, the chamber 111 is disposed at the second end of the main casing 11. The axial hole 112 extends from the first end of the main casing 11 to an upper of the chamber 111 and fluidly communicates with the chamber 111. The crescent protrudes from the upper of the chamber 111 and into the chamber 111. The crescent is curved and surrounds the axial hole 112. The communicating hole 114 is disposed inside the main casing 11 and communicates with the axial hole 112 and the chamber 111.

With reference to FIGS. 2, 4, 7, and 8, the supplementary casing 12 is connected to the main casing 11, and the main casing 11 is closed and sealed by the supplementary casing 12. The supplementary casing 12 has a first side and a second side opposite to the first side of the supplementary casing 12. The supplementary casing 12 further has a leading-in indent 121, a leading-out indent 122, two leading-in holes 123, a leading-out hole 124, and a gas recess 125. The leading-in indent 121 and the leading-out indent 122 are both formed in the first side of the supplementary casing 12. Each of the two leading-in holes 123 extends from a bottom of the leading-in indent 121 and through the second side of the supplementary casing 12. The leading-out hole 124 extends from a bottom of the leading-out indent 122 and through the second side of the supplementary casing 12. The gas recess 125 is formed in the second side of the supplementary casing 12.

Figure 4:
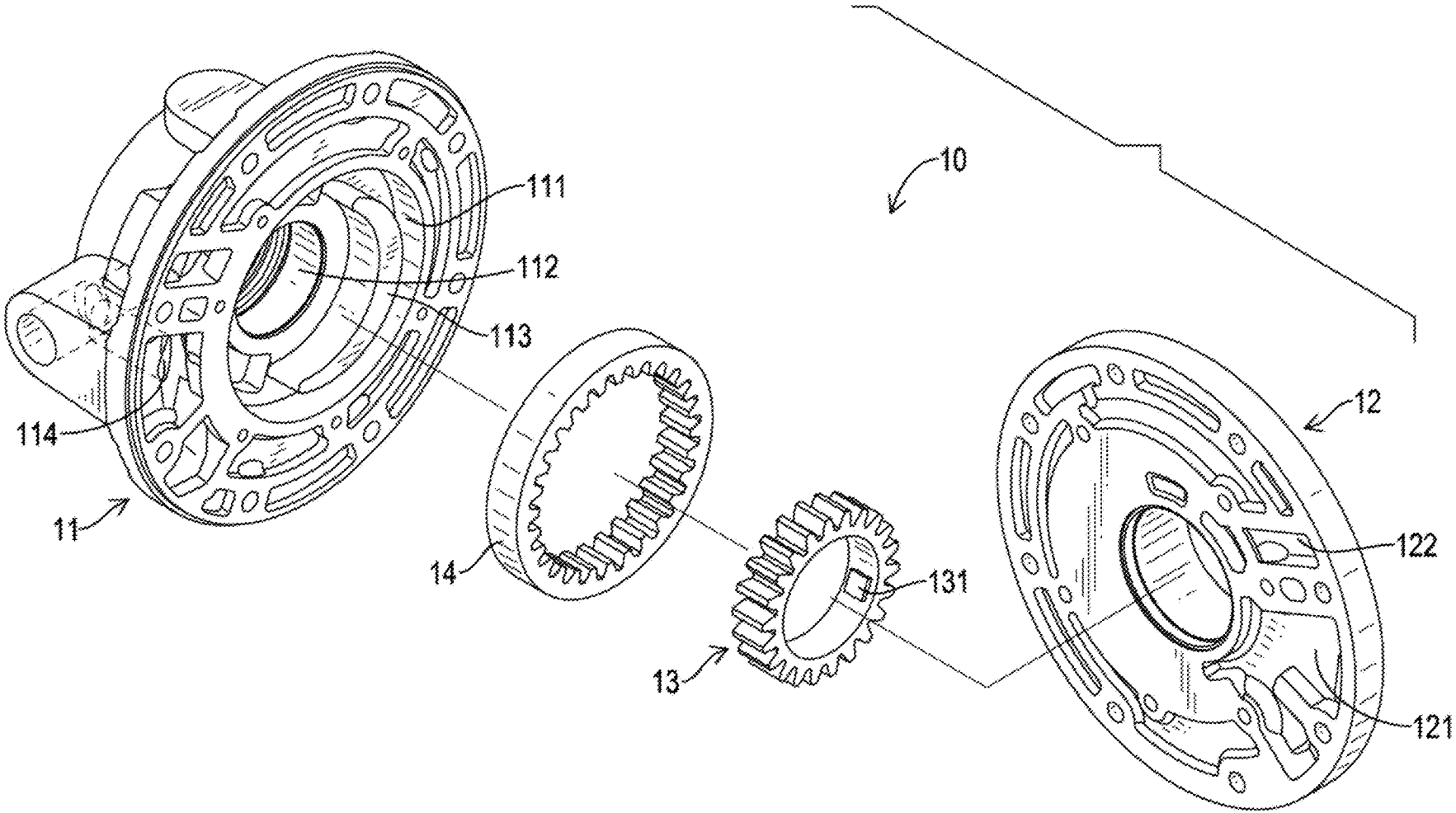
FIG. 4 is an exploded perspective view of a cooling pump of the cooling pump assembly in FIG. 1.
Figure 6:
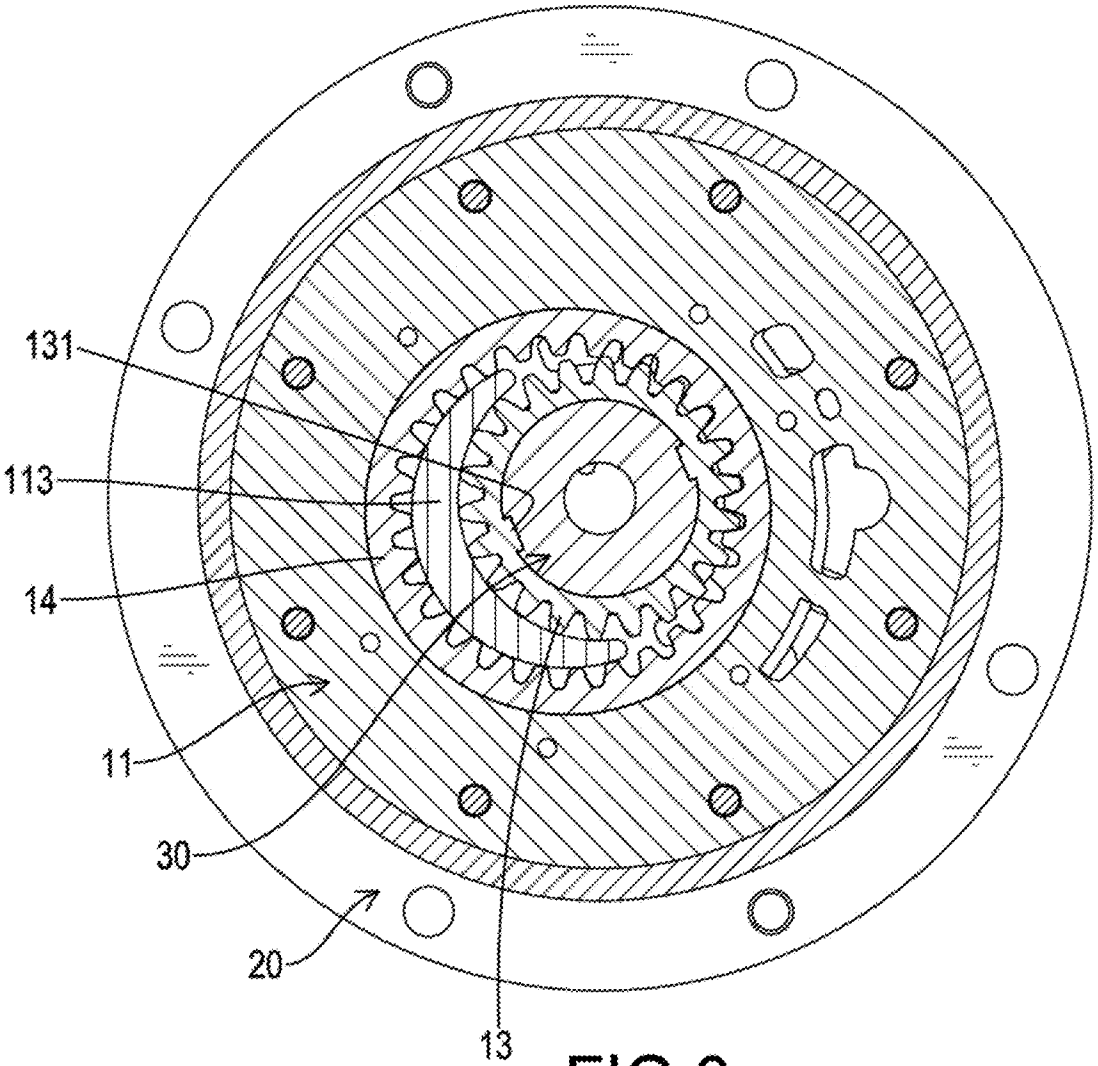
FIG. 6 is a cross-sectional side view of the cooling pump assembly in FIG. 1.
Figure 7:
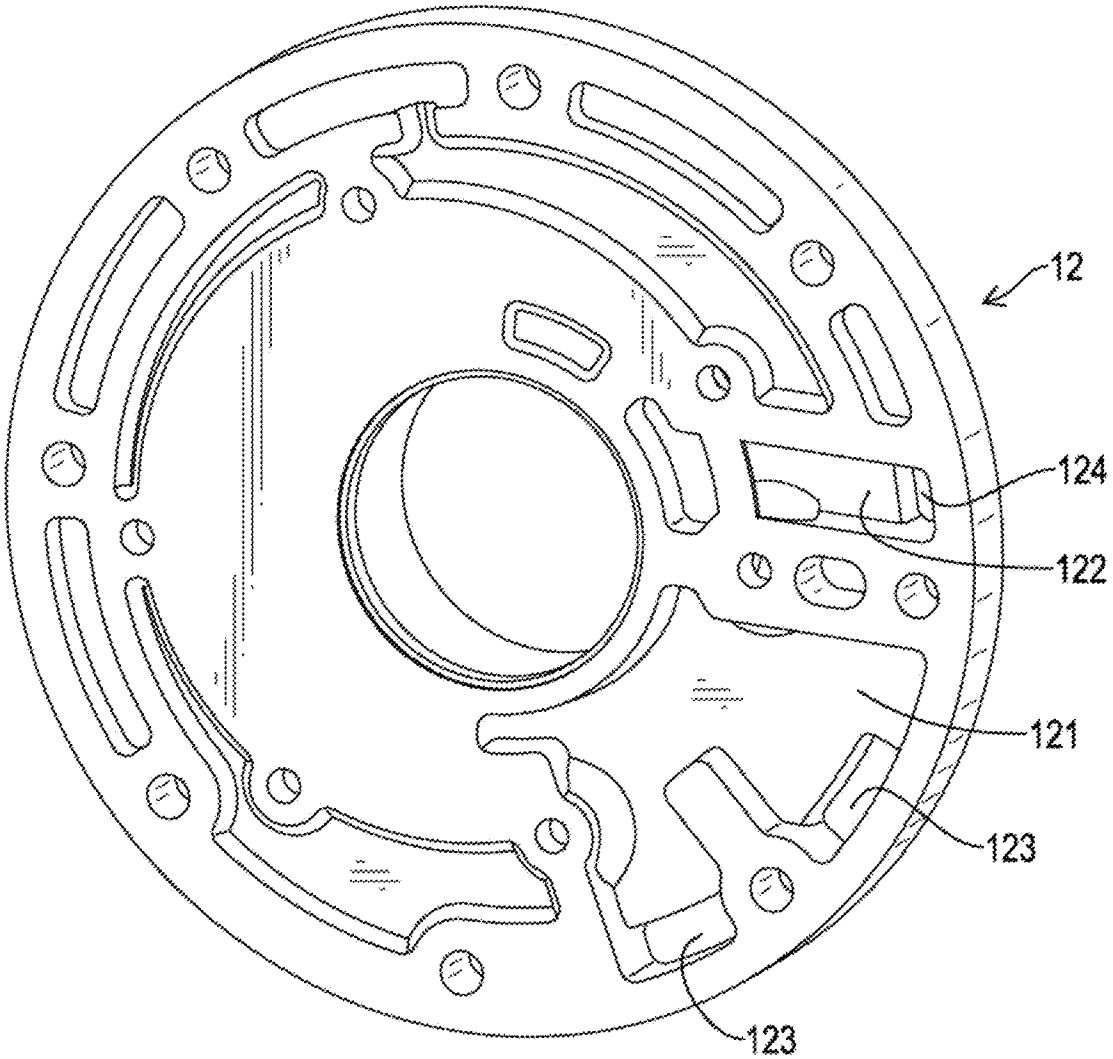
FIG. 7 is a perspective view of a supplementary casing of the cooling pump in FIG. 4.
Figure 8:
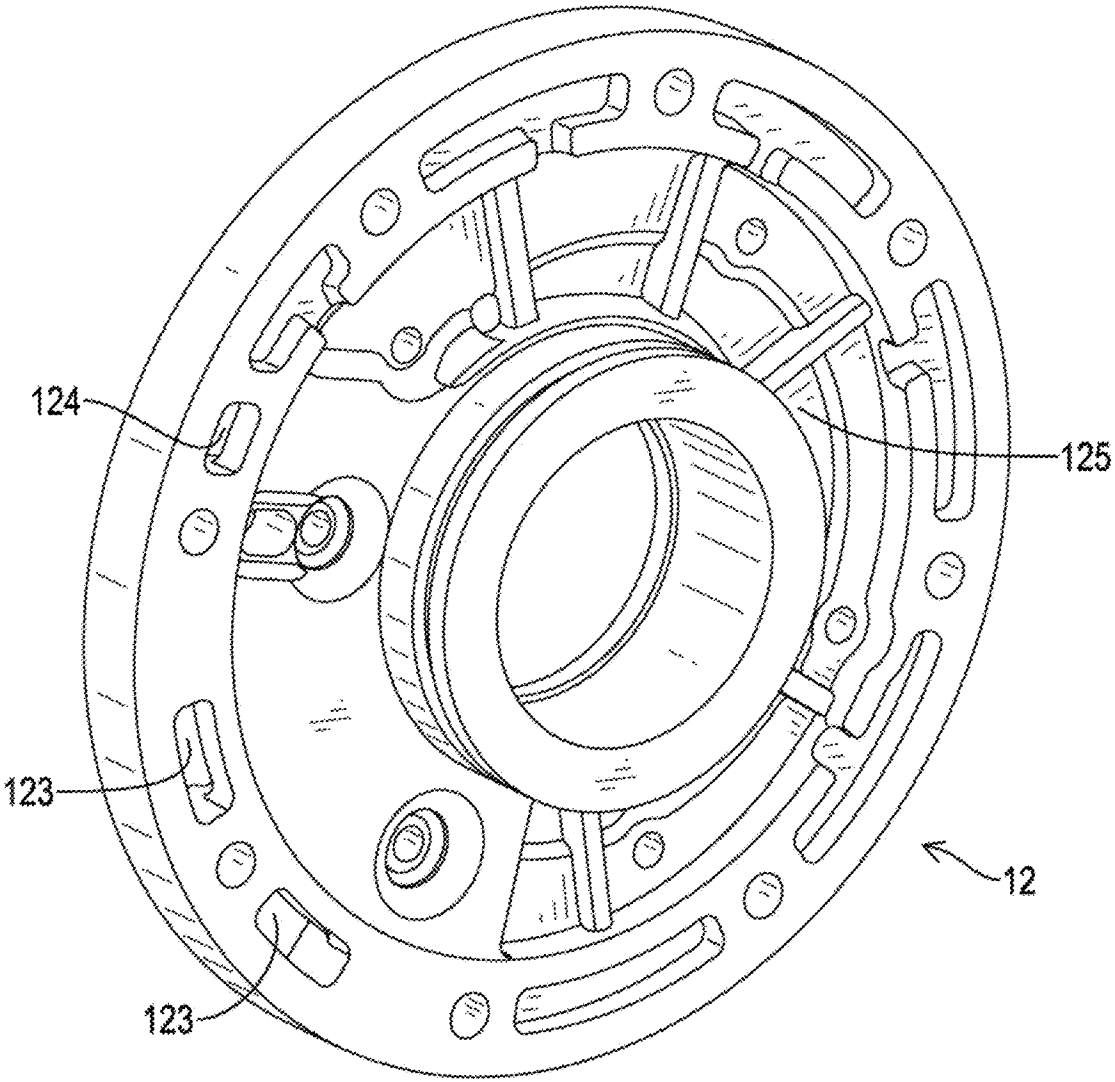
FIG. 8 is another perspective view of a supplementary casing of the cooling pump in FIG. 4.

With reference to FIGS. 2, 4, and 6, the inner gear 13 and the outer gear are rotatably disposed inside the chamber 111 of the main casing 11 and between the main casing 11 and the supplementary casing 12. Wherein, the inner gear 13 and the axial hole 112 of the main casing 11 are coaxially arranged. The outer gear 14 is circular and encloses the inner gear 13 and the crescent 113 of the main casing 11. The outer gear 14 and the inner gear 13 are eccentric and engage with each other.

Figure 9:
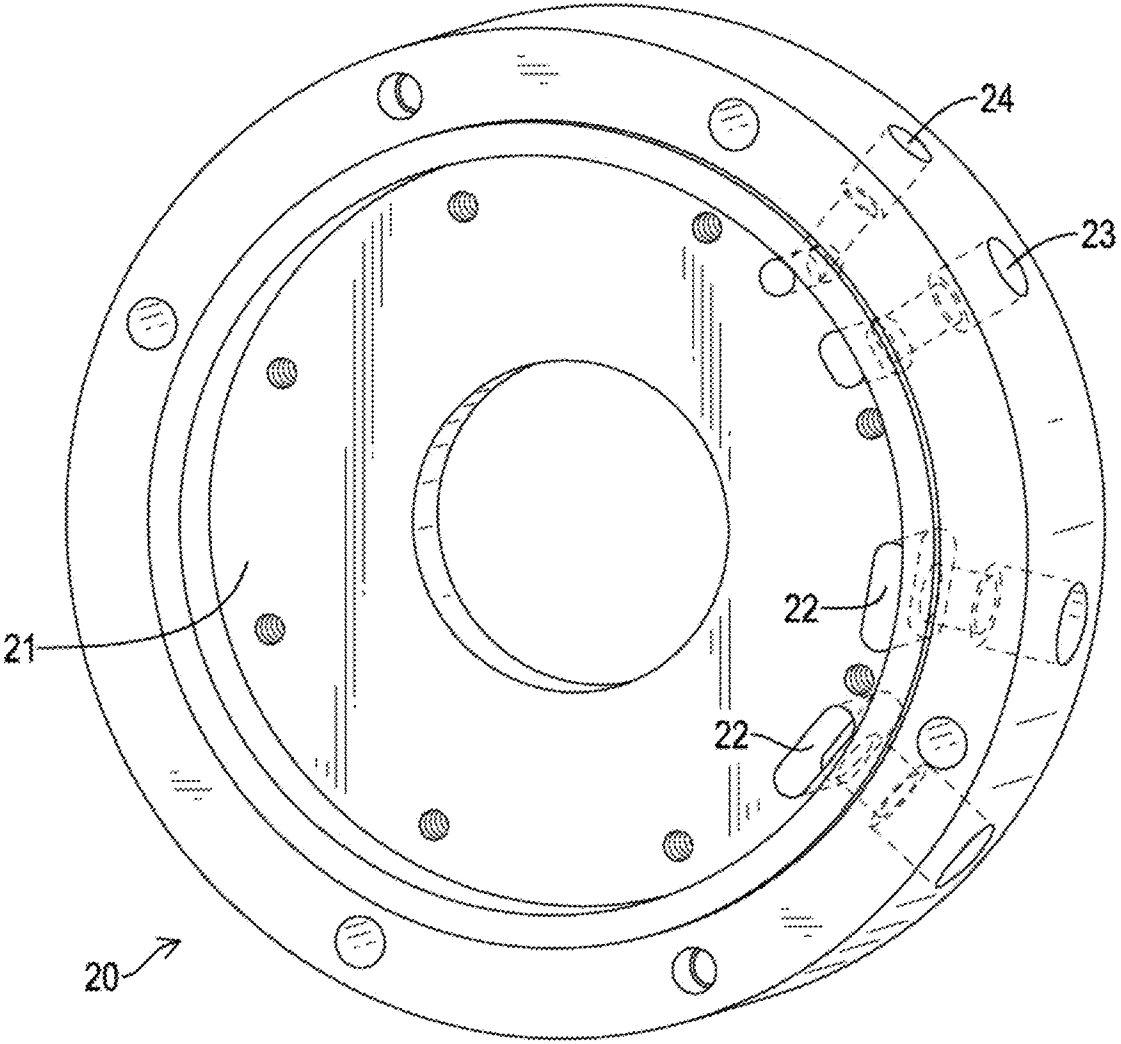
FIG. 9 is a perspective view of a mount of the cooling pump assembly in FIG. 1.

With reference to FIGS. 2, 3, and 9, the mount 20 and the cooling pump 10 are connected to each other with bolts. The mount 20 has a first side and a second side opposite to the first side of the mount 20. The mount 20 further has a recess 21, two receiving holes 22, a discharging hole 23, and an exhaust hole 24. The recess 21 is formed in the second side of the mount 20, receives the supplementary casing 12, and fluidly communicates with the leading-in holes 123, the leading-out hole 124, and the gas recess 125. The two receiving holes 22 are formed in a bottom of the recess 21 and fluidly communicate with the two leading-in holes 123 respectively. The discharging hole 23 extends from the bottom of the recess 21 to a circumference of the mount 20 and fluidly communicates with an exterior of the mount 20. The exhaust hole 24 also extends from the bottom of the recess 21 to the circumference of the mount 20 and fluidly communicates with the exterior of the mount 20.

With reference to FIGS. 2 and 3, the shaft 30 has an input end 301 and an output end 302 opposite to the input end 301 of the shaft 30. The shaft 30 is rotatably mounted in the axial hole 112 of the main casing 11, engages with the inner gear 13 via a key 131, and is configured to drive the inner gear 13 to rotate. The output end 302 of the shaft 30 is disposed outside the mount 20. The input end 301 of the shaft 30 extends through the supplementary casing 12, the inner gear 13, and the main casing 11. The shaft 30 further has a channel 31, multiple guiding holes 32, and a driven portion 33. The channel 31 axially extends from the input end 301 of the shaft 30 toward the output end 302 of the shaft 30. The multiple guiding holes 32 radially extend from a circumference of the shaft and fluidly communicate with the channel 31. The driven portion 33 is disposed at the input end 301 of the shaft 30 and has multiple engaging teeth formed at a circumference of the shaft 30.

With reference to FIGS. 2 and 3, the driving set 40 has an assembling mount 41 and a driving unit 42. The assembling mount 41 is configured to be fixed to a stationary object such as a machine or a frame for supporting the cooling pump assembly 100 of the present invention. The driving unit 42 has a first end and a second end opposite to the first end of the driving unit 42 and further has a central hole 421, a driving portion 422, and a flange 423. The central hole 421 extends from the first end of the driving unit 42 to the second end of the driving unit 42. The driving portion 422 is disposed at the first end of the driving unit 42 and has multiple engaging teeth formed at a circumference of the central hole 421. The flange 423 is disposed at the first end of the driving unit 42 and is configured to be connected to said device to be cooled such as the coupling that increases its rotational inertia by flowing fluid. The driving unit 42 is mounted on and around the shaft 30 and rotatably inserted in the assembling mount 41. The second end of the driving unit 42 is inserted in the axial hole 112 of the main casing 11 and fluidly communicates with the axial hole 112 via the central hole 421. The central hole 421 fluidly communicates with the channel 31 of the shaft 30 via the multiple guiding holes 32 of the shaft 30. The driving portion 422 of the driving unit 42 and the driven portion 33 of the shaft 30 engage with each other to connect the driving unit 42 and the shaft 30 and to rotate the shaft 30.

Figure 10:
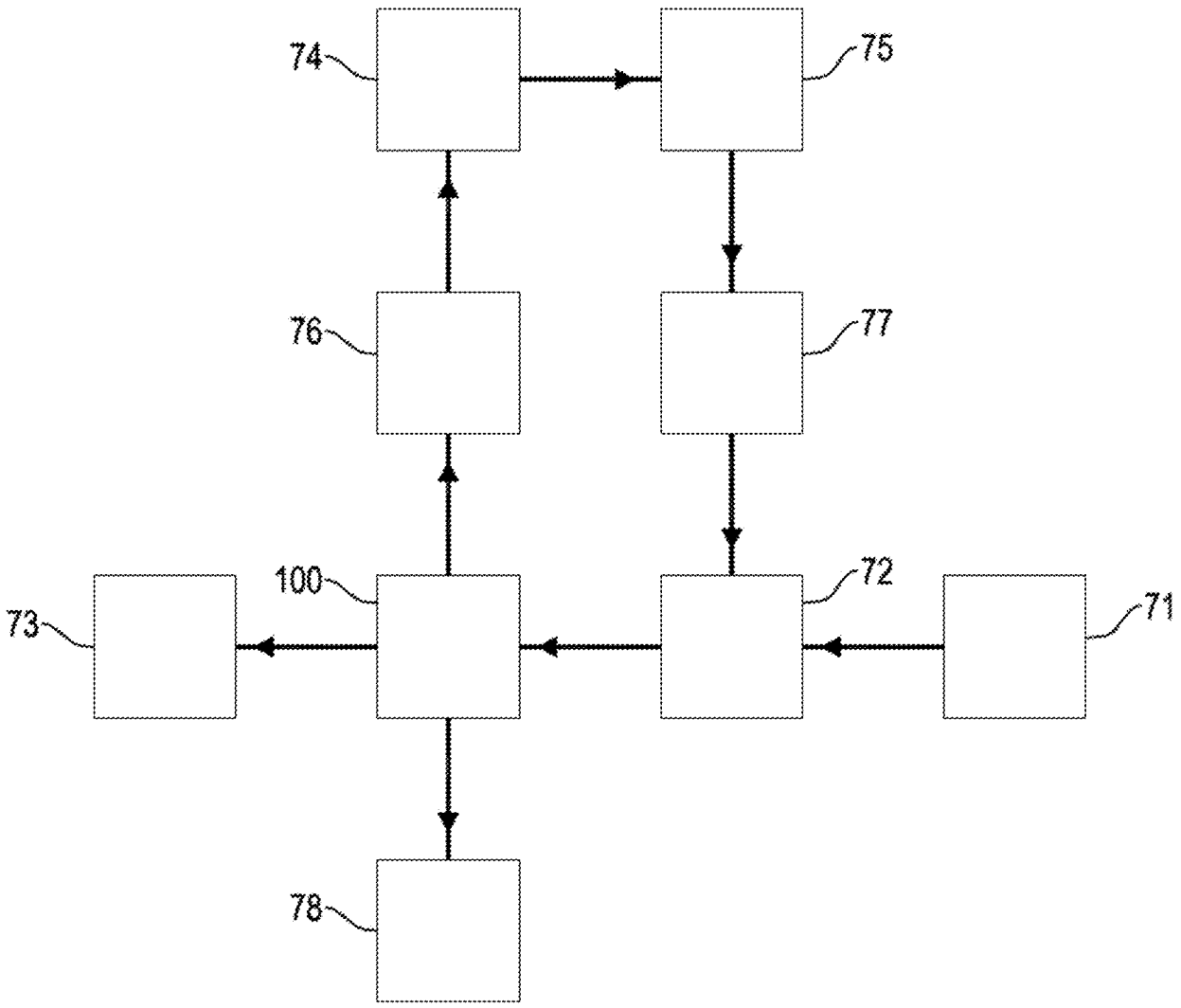
FIG. 10 is a block diagram showing operation of the present invention.

With reference to FIG. 10, the cooling pump assembly 100 of the present invention can operate with a motor 71, a device to be cooled 72, a loading device 73, a cooling device 74, a liquid reservoir 75, a first filter 76, a second filter 77, and a gas filter 78. Wherein, the motor 71 is connected to and drives the device to be cooled 72. The device to be cooled 72, the cooling pump assembly 100, and the second filter 77 fluidly communicate with one another. The second filter 77 fluidly communicates with the liquid reservoir 75. The cooling pump assembly 100 is connected to the loading device 73. The cooling pump assembly 100 also fluidly communicates with the first filter 76 and the gas filter 78. The first filter 76 fluidly communicates with the liquid reservoir 75.

Specifically, the device to be cooled 72 may comprise a coupling that increases its rotational inertia by flowing fluid, and the loading device 73 may comprise an electrical generator. The cooling pump assembly 100 is connected to the device to be cooled 72 and the loading device 73. The cooling pump assembly 100 can be driven by the device to be cooled 72 and drive the loading device 73. The cooling pump assembly 100 can connect the device to be cooled 72, the coupling increasing its rotational inertia by flowing fluid, via the flange 423 of the driving unit 42. The cooling pump assembly 100 can connect the loading device 73 via the output end 302 of the shaft 30 and to drive the loading device 73 to generate electricity.

Figure 5:
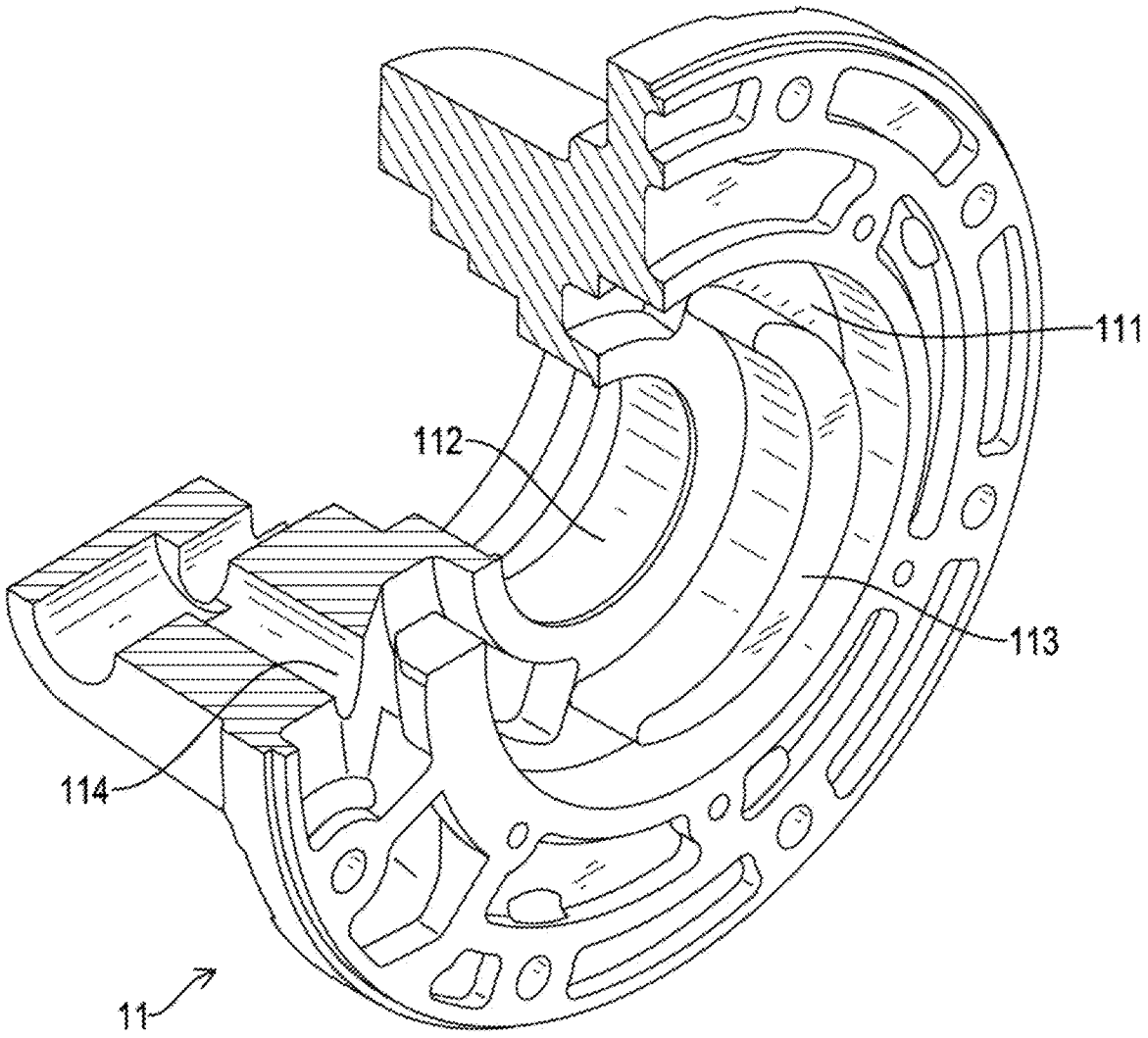
FIG. 5 is a perspective view of a main casing of the cooling pump in FIG. 4.

With reference to FIGS. 2 and 5, liquid coolant absorbing heat energy from the device to be cooled 72 enters the channel 31 of the shaft 30 from the input end 301 of the shaft 30. Said liquid coolant enters the central hole 421 of the driving unit 42 via the guiding holes 32 of the shaft 30. The liquid coolant flows between the shaft 30 and the driving unit 42. Then, the liquid coolant enters the cooling pump 10 and flows into the chamber 111 of the main casing 11 via the communicating hole 114 of the main casing 10.

Meanwhile, with reference to FIG. 6, the inner gear 13 and the outer gear 14 disengage to generate negative pressure, and the liquid coolant is sucked into the cooling pump 10 via the leading-in indent 121 of the supplementary casing 12 accordingly. At the leading-out indent 122 of the supplementary casing 12, the inner gear 13 and the outer gear 14 engage to press the liquid coolant, so the liquid coolant that cannot be compressed is pushed out from the cooling pump 10 via the leading-out hole 124. The liquid coolant out of the cooling pump 10 enters the recess 21 and the discharging hole 23 of the mount 20 and is discharged from the circumference of the mount 20.

With reference to FIG. 10, the liquid coolant discharged from the mount 20 enters the first filter 76 to be filtrated for removing impurities or iron filings. Then, the liquid coolant enters the cooling device 74 for heat exchange and cooling. The cooled-down liquid coolant is transmitted to the liquid reservoir 75 and can be further transmitted to the second filter 77 for filtration. Eventually, the liquid coolant can be transmitted to the device 72 to be cooled for recycling.

With reference to FIGS. 2, 4, and 5, when the liquid coolant enters the cooling pump 10, part of the liquid coolant enters the two receiving holes 22 of the mount 20 via the two leading-in holes 123 of the supplementary casing 12.

With reference to FIG. 10, hot gas generated by the liquid coolant inside the cooling pump 10 and the mount 20 enters the exhaust hole 24 of the mount 20 via the gas recess 125 of the supplementary casing 12 and exhausts from the mount 20 via the exhaust hole 24. The heat gas enters the gas filter 78 for filtration and is exhausted into the air.

With reference to FIG. 2, the main casing 11 has two O-rings O and a sleeve S disposed inside the main casing 11. One of the O-rings O of the main casing 11 is disposed at the first end of the main casing 11 and sleeved at the second end of the driving unit 42 to prevent the liquid coolant from leakage between the driving unit 42 and the main casing 11. The other one of the O-rings O of the main casing 11 is sleeved on the shaft 30 to prevent the liquid coolant from flowing between the main casing 11 and the shaft 30. The sleeve S of the main casing 11 is sleeved on the shaft 30 between the shaft 30 and the main casing 11 to let the shaft 30 smoothly rotate inside the main casing 11.

With reference to FIG. 2, the supplementary casing 12 has a sleeve S. The sleeve S of the supplementary casing 12 is sleeved on the shaft 30 between the shaft 30 and the supplementary casing 12 to let the shaft 30 smoothly rotate inside the supplementary casing 12.

With reference to FIG. 2, the mount 20 has a bearing B and an O-ring O. The bearing B of the mount 20 is sleeved on the shaft 30 between the shaft 30 and the mount 20 to let the shaft 30 smoothly rotate inside the mount 20. The O-ring O of the mount 20 is sleeved on the shaft 30 and disposed at the second side of the mount 20 to prevent the liquid coolant from leaking out of the mount 20.

With reference to FIG. 2, the driving unit 42 has two bearings B. The two bearings B are sleeved on the driving unit 42 between the assembling mount 41 and the driving unit 42 to let the driving unit 42 smoothly rotate inside the assembling mount 41.

In the cooling pump assembly 100 of the present invention, the shaft 30 engages with the inner gear 13 inside the cooling pump 10 and connects to the loading device 73 via the output end 302 of the shaft 30. In addition, the shaft 30 connects to the device to be cooled 72 via the driving unit 42 of the driving set 40. Therefore, the motor 71 can drive the cooling pump assembly 100 and the loading device 73 together. Compared to the conventional cooling pump, the cooling pump assembly 100 of the present invention can be driven with the loading device 73 without an additional motor specially for driving the cooling pump assembly 100. Consequently, energy for driving the cooling pump assembly 100 and the loading device 73 is saved, and cost for purchasing motors is saved. Functions of saving energy and cooling are both achieved.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cooling pump assembly comprising:

a cooling pump having a main casing having a first end and a second end opposite to the first end of the main casing;

a chamber disposed at the second end of the main casing;

an axial hole extending from the first end of the main casing and fluidly communicating with the chamber;

a crescent being curved, disposed inside the chamber, and surrounding the axial hole; and a communicating hole fluidly communicating with the axial hole and the chamber;

a supplementary casing connected to the main casing, closing the chamber, and having a first side and a second side opposite to the first side of the supplementary casing;

a leading-in indent disposed at the first side of the supplementary casing;

a leading-out indent disposed at the first side of the supplementary casing;

at least one leading-in hole, each of the at least one leading-in hole extending from a bottom of the leading-in indent and extending through the second side of the supplementary casing; and a leading-out hole extending from a bottom of the leading-out indent and extending through the second side of the supplementary casing;

an inner gear rotatably disposed inside the chamber and being coaxial with the axial hole;

an outer gear rotatably disposed inside the chamber, enclosing the inner gear and the crescent, and engaging with the inner gear;

the outer gear and the inner gear being eccentric;

a mount having a first side and a second side opposite to the first side of the mount;

a recess disposed at the first side of the mount, receiving the supplementary casing, and fluidly communicating with the at least one leading-in hole and the leading-out hole; and a discharging hole extending from a bottom of the recess and fluidly communicating with an exterior of the mount;

a shaft rotatably mounted in the axial hole, engaging with the inner gear, and having an input end and an output end opposite to the input end of the shaft;

a channel extending from the input end of the shaft toward the output end of the shaft; and multiple guiding holes radially extending from a circumference of the shaft and fluidly communicating with the channel; and a driving set having a driving unit connected to the shaft, inserted in the axial hole, and having a first end and a second end opposite to the first end of the driving unit;

a central hole extending to the first end and the second end of the driving unit, and fluidly communicating with the axial hole; and the driving unit mounted on and around the shaft by the central hole, and the central hole fluidly communicating with the channel via the multiple guiding holes.

2. The cooling pump assembly as claimed in claim 1, wherein the driving unit has a driving portion having multiple engaging teeth formed at a circumference of the central hole;

the shaft has a driven portion having multiple engaging teeth formed at the circumference of the shaft; and the driving portion of the driving unit engages with the driven portion of the shaft.

3. The cooling pump assembly as claimed in claim 2, wherein the driving set has an assembling mount configured to be fixed to a stationary object for supporting the cooling pump assembly; and the driving unit is rotatably inserted in the assembling mount.

4. The cooling pump assembly as claimed in claim 3, wherein the driving unit has a flange disposed adjacent to the first end of the driving unit.

5. The cooling pump assembly as claimed in claim 4, wherein the supplementary casing has a gas recess disposed at the second side of the supplementary casing and fluidly communicating with the recess of the mount; and the mount has an exhaust hole extending from the bottom of the recess and fluidly communicating with the exterior of the mount.

6. The cooling pump assembly as claimed in claim 4, wherein the mount has at least one receiving hole, and each of the at least one receiving hole is formed in the bottom of the recess and fluidly communicates with the at least one leading-in hole of the supplementary casing.

7. The cooling pump assembly as claimed in claim 3, wherein the supplementary casing has a gas recess disposed at the second side of the supplementary casing and fluidly communicating with the recess of the mount; and the mount has an exhaust hole extending from the bottom of the recess and fluidly communicating with the exterior of the mount.

8. The cooling pump assembly as claimed in claim 3, wherein the mount has at least one receiving hole, and each of the at least one receiving hole is formed in the bottom of the recess and fluidly communicates with the at least one leading-in hole of the supplementary casing.

9. The cooling pump assembly as claimed in claim 2, wherein the supplementary casing has a gas recess disposed at the second side of the supplementary casing and fluidly communicating with the recess of the mount; and the mount has an exhaust hole extending from the bottom of the recess and fluidly communicating with the exterior of the mount.

10. The cooling pump assembly as claimed in claim 2, wherein the mount has at least one receiving hole, and each of the at least one receiving hole is formed in the bottom of the recess and fluidly communicates with the at least one leading-in hole of the supplementary casing.

11. The cooling pump assembly as claimed in claim 1, wherein the driving set has an assembling mount configured to be fixed to a stationary object for supporting the cooling pump assembly; and the driving unit is rotatably inserted in the assembling mount.

12. The cooling pump assembly as claimed in claim 11, wherein the supplementary casing has a gas recess disposed at the second side of the supplementary casing and fluidly communicating with the recess of the mount; and the mount has an exhaust hole extending from the bottom of the recess and fluidly communicating with the exterior of the mount.

13. The cooling pump assembly as claimed in claim 11, wherein the mount has at least one receiving hole, and each of the at least one receiving hole is formed in the bottom of the recess and fluidly communicates with the at least one leading-in hole of the supplementary casing.

14. The cooling pump assembly as claimed in claim 1, wherein the supplementary casing has a gas recess disposed at the second side of the supplementary casing and fluidly communicating with the recess of the mount; and the mount has an exhaust hole extending from the bottom of the recess and fluidly communicating with the exterior of the mount.

15. The cooling pump assembly as claimed in claim 1, wherein the mount has at least one receiving hole, and each of the at least one receiving hole is formed in the bottom of the recess and fluidly communicates with the at least one leading-in hole of the supplementary casing.

* * * * *